US005603129A

United States Patent [19]

Chou

[11] Patent Number: 5,603,129

[45] Date of Patent: Feb. 18, 1997

[54] PANEL WALL POOL

[75] Inventor: Lin L. Chou, Taipei Hsien, Taiwan

[73] Assignee: Intex Recreation Corp., Long Beach, Calif.

[21] Appl. No.: 934,944

[22] Filed: Aug. 25, 1992

Related U.S. Application Data

[63] Continuation-in-part of Ser. No. 894,019, Jun. 5, 1992, abandoned.

[51] Int. Cl.[6] ..... E04H 4/00

[52] U.S. Cl. ..... 4/506; 220/666

[58] Field of Search ..... 4/506, 513, 585; 220/666

[56] References Cited

U.S. PATENT DOCUMENTS

| | | | |
|---|---|---|---|
| 841,170 | 1/1907 | Nacht et al. | 383/119 X |
| 3,631,544 | 1/1972 | Tytel | 4/506 |

FOREIGN PATENT DOCUMENTS

| | | | |
|---|---|---|---|
| 0256392 | 8/1967 | Austria | 4/506 |
| 2226128 | 12/1973 | Germany | 4/506 |
| 1251094 | 10/1971 | United Kingdom | 4/506 |
| 1261770 | 1/1972 | United Kingdom | 4/506 |

*Primary Examiner*—Robert M. Fetsuga

*Attorney, Agent, or Firm*—David N. Makous; John Christopher

[57] ABSTRACT

The panel wall pool includes a sidewall with spaced apart panels supported in an upright position when the pool is empty by an inflatable ring, which also provides the protection of a cushion along the top of the sidewall area. The sidewall also includes a reinforcing band which encircles the panels to bind the panels together to substantially prevent individual panels from being forced outward and to help to prevent the outward bending or bowing of the sidewall of the pool.

7 Claims, 2 Drawing Sheets

FIG. 1
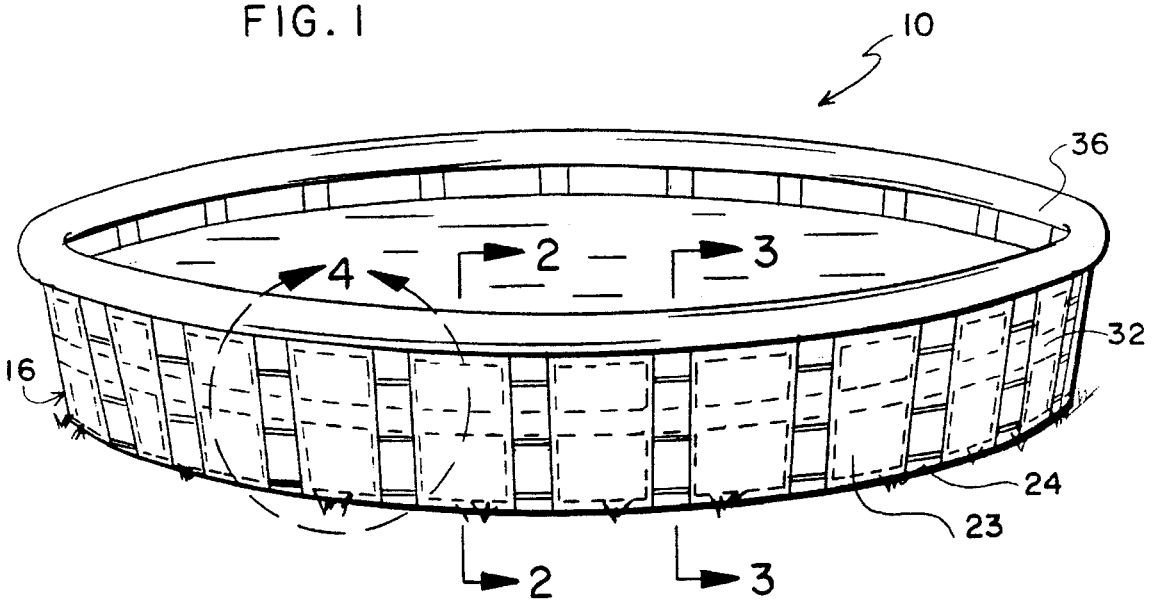
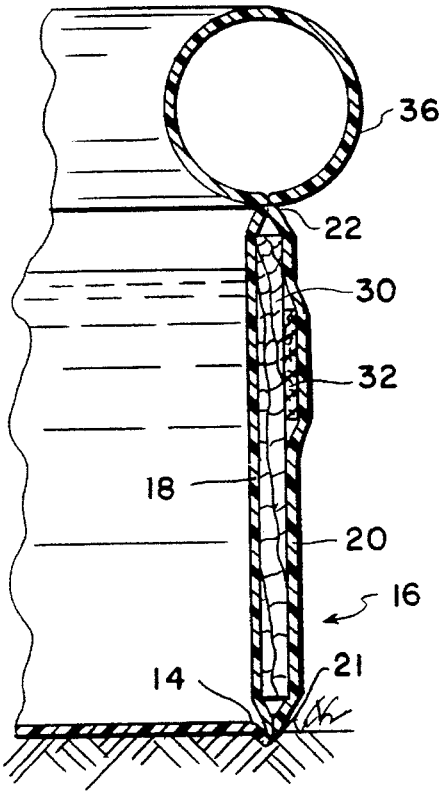
FIG. 2
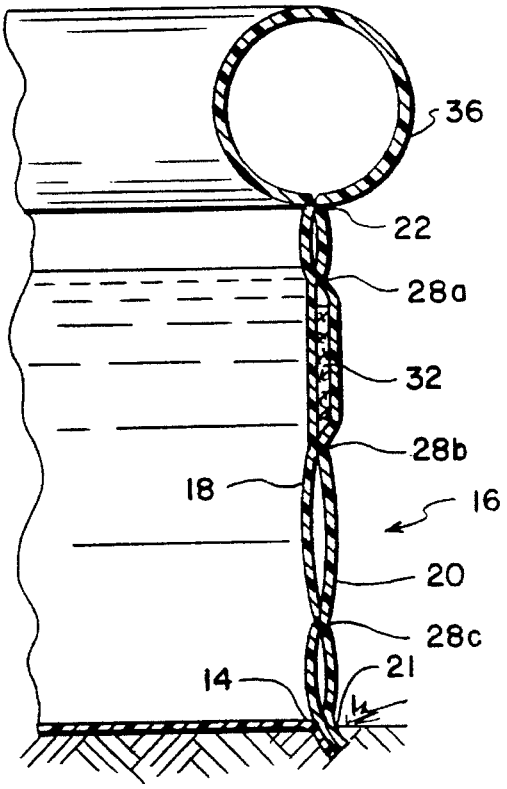
FIG. 3

PANEL WALL POOL

RELATED APPLICATIONS

This is a continuation-in-part of Ser. No. 07/894,019, filed Jun. 5, 1992, now abandoned.

BACKGROUND OF THE INVENTION

1. Field of the Invention

This invention relates generally to inflatable swimming or wading pools, and more particularly concerns an inflatable, collapsible swimming or wading pool having a reinforced sidewall.

2. Description of Related Art

Inflatable swimming pools and wading pools are typically formed from thermoplastic sheeting, cut and bonded together to construct a circular pool with a thin bottom wall, and an inflatable sidewall which extends away from the bottom wall when it is inflated. The sidewall typically is formed of a sheet of thermoplastic material folded over and bonded to the bottom wall, and may include horizontal or vertical ribs or seams formed by heat sealing the inside and outside layers of the sidewall together. Compartments may also be formed in the inflatable sidewalls, with inflation ports being provided for each separate compartment.

The sidewalls of such inflatable pools are generally weak and susceptible to collapse or punctures from rough play. One type of collapsible pool includes spaced apart panels extending from the bottom of the pool, in a flexible sidewall covering, to provide a more durable, stronger sidewall that is held upright by the pressure of water in the pool, once it is filled. However, until the pool is filled with water, the panels must be balanced in an upright position, making unfolding and filling of the pool inconvenient. The spaced apart panels also do not provide the cushioning effect of inflated sidewalls, and can be individually moved by rough play. It would therefore be desirable to provide a collapsible panel wall pool with a sidewall that can stand without outside support. It would also be desirable to provide a collapsible panel wall pool with a cushioning sidewall area, and reinforced sidewalls to better withstand rough play.

SUMMARY OF THE INVENTION

Briefly, and in general terms, the present invention provides for a collapsible panel wall pool with a sidewall that includes spaced apart panels supported in an upright position when the pool is empty by an inflatable ring, which also provides the protection of a cushion along the top of the sidewall area. The sidewall also includes a reinforcing band which encircles the panels to bind the panels together to substantially prevent individual panels from being forced outward.

The invention accordingly provides for a collapsible wading pool having a bottom wall, and a peripheral upright wall connected to the outer edge of the bottom wall. The peripheral upright wall preferably contains a plurality of spaced apart, vertically oriented pockets formed of at least two layers of material, and each pocket contains a rigid, generally rectangular planar panel. A reinforcing band encircles the panels in the pockets; and an inflatable top ring is connected to the upper edge of the upright wall. Horizontal and vertical heat seals are also preferably provided between two layers of plastic material forming the sidewall.

These and other aspects and advantages of the invention will become apparent from the following detailed description, and the accompanying drawing, which illustrates by way of example the features of the invention.

BRIEF DESCRIPTION OF THE DRAWINGS

FIG. 1 is a front perspective view of the panel wall pool of the invention;

FIG. 2 is an enlarged cross-sectional view of the panel wall pool taken along line 2—2 of FIG. 1;

FIG. 3 is an enlarged cross-sectional view of the panel wall pool taken along line 3—3 of FIG. 1.

DETAILED DESCRIPTION OF A PREFERRED EMBODIMENT

Figure 4:
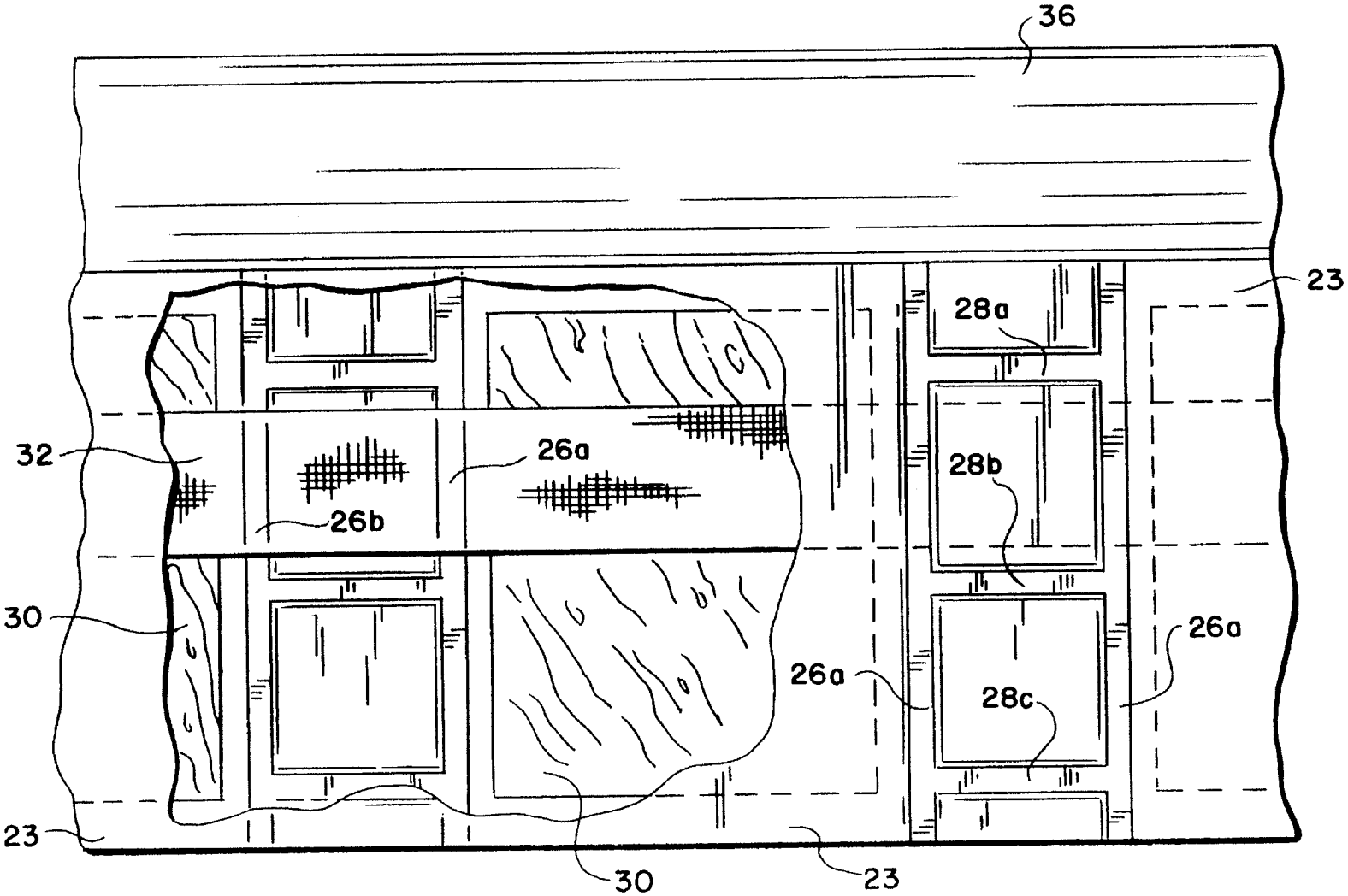
FIG. 4 is an enlarged front elevation view of a portion of the sidewall of the panel wall pool and a partial cutaway view of the interior of the sidewall.

As is illustrated in the drawings, and particularly with reference to FIGS. 1–3, the invention is embodied in a collapsible wading pool or swimming pool 10 having a bottom wall 12 preferably formed of at least one layer of thermoplastic sheet material. The bottom wall 12 is preferably formed of a vinyl plastic such as polyvinyl chloride, although polyvinyl chloride copolymers, polymers containing the vinyl radical ($CH_2$=CH—) or the vinylidene radical ($CH_2$=C<), nylon, linear polyethylene, polystyrene, polypropylene and the like may also be suitable. The bottom wall 12 is preferably formed in the shape of a circle, although other geometric shapes such as a hexagon or octagon and the like can also be used. The bottom wall 12 has an outer edge 14 as shown in FIGS. 2 and 3, which is preferably joined by heat sealing to a peripheral upright sidewall 16 which preferably includes a first inner layer of thermoplastic sheet 18, and a second outer layer of plastic sheet 20 which are joined together by heat sealing at their bottom edge 21 and joined to the outer edge 14 of the bottom wall 12 by heat sealing. The inner and outer layers 18 and 20, respectively of the upright sidewall 16 are preferably joined together at their top edge 22, with both layers being formed from a single sheet of thermoplastic material folded over at the top, although the two layers can also be formed from separate sheets bonded together at their top edge by heat sealing. The preferred method of bonding the thermoplastic sheet material by heat sealing is by RF induced electronic welding, although heat sealing with a hot bar or other type of heated tool may be suitable for appropriate thermoplastic sheet materials. The inner and outer sidewall layers 18 and 20, respectively are also preferably formed of a vinyl plastic such as polyvinyl chloride, although polyvinyl chloride copolymers, polymers containing the vinyl radical ($CH_2$=CH—) or the vinylidene radical ($CH_2$=C<), nylon, linear polyethylene, polystyrene, polypropylene and the like may also be suitable. The sidewall may also include additional layers, such as an outer decorative layer, or an inner decorative or cushion layer, or the like.

Referring to FIGS. 2–4, the peripheral upright sidewall 16 preferably contains a plurality of spaced apart, vertically oriented pockets 23 formed between the upper and lower edges 22 and 21 respectively, of the sidewall 16 and a plurality of heat seal regions 24 in the two layers of plastic 18 and 20 respectively, in the sidewall 16. Each of the heat seal regions 24 is preferably formed from a pair of right and left vertical heat seals 26*a,b* between the two layers of material, and a plurality of horizontal heat seals 28*a,b,c* extending between the vertical heat seal pairs.

Each of the pockets 23 also contains a rigid, generally planar panel 30, which in the preferred embodiment is a thin rectangular panel preferably formed of wood or other similar materials which will resist outward bending and bowing such as wood composites, particle board, chip board, flake board, plywood, fiberboard, Masonite, hardboard, and the like. Various other materials having similar characteristics which will resist outward bending and bowing, such as hard plastics and the like, may also be suitable. Although the panels preferably have a rectangular shape, they may have other shapes, such as a triangular shape, and the corners are preferably rounded and the edges are preferably radiused in order to prevent the panels from puncturing the walls of the pool. The panels are typically about 5 ½ inches (about 14 cm.) wide, about 9 ⅜ inches (about 23.8 cm.) high, and about ⅛ inch (about 0.32 cm.) thick. The thickness of the panels 30 preferably varies as a function of the anticipated height of water in the pool (which corresponds generally to the height of the panels, and is also typically related to the diameter of the pool). The thickness of the planar panels 30 ranges from about ⅛ inch (about 0.32 cm.) to about ¾ inch (about 1.90 cm.) for panel heights ranging from about 4 inches (about 10 cm.) to about 30 inches (about 76 cm.). The width of the panels typically also varies according to the diameter of the pool, from about 3 inches (about 7.6 cm.) to about 7 inches, for pools ranging in diameter from about 4 feet to about 20 feet. A spacing of about 1.5 inches (3.8 cm.) is typically provided between panels 30.

A reinforcing band 32 is also preferably provided outside the panels, encircling them, covered by the layers of plastic sheet 18 and 20 of the sidewall 16, to function as a restraining belt or band to help prevent the outward bending or bowing of the walls of the pool. The reinforcing band 32 is also preferably heat sealed at the vertical seals at 26*a,b* between the two layers of plastic sheet 18 and 20 of the sidewall 16, and is preferably disposed between the upper two horizontal heat seals 28*a,b* of each heat seal region 24. The reinforcing band 32 is preferably about 3 inches wide, but typically can range in width from about ½ inch (about 1.3 cm.) to about 4 inches (about 10 cm.). The reinforcing band 32 is preferably made of an inelastic, thermoplastic plastic material, such as polyvinyl chloride or nylon, although polyvinyl chloride copolymers, polymers containing the vinyl radical ($CH_2$=CH—) or the vinylidene radical ($CH_2$=C<), linear polyethylene, polystyrene, polypropylene and the like may also be suitable.

An elongated inflatable top ring 36 is bonded to the upper edge of the upright sidewall 16 by heat seals, and is preferably formed of an elongated thermoplastic sheet with its edges heat sealed together. An inflation stem (not shown) is also provided in the top ring 36 for inflation and deflation there of. The inflatable top ring 36 is preferably made of thermoplastic material, such as polyvinyl chloride, although polyvinyl chloride copolymers, polymers containing the vinyl radical ($CH_2$=CH—) or the vinylidene radical ($CH_2$=C<), nylon, linear polyethylene, polystyrene, polypropylene and the like may also be suitable.

The inflatable top ring 36 is useful in setting up the pool 10 of the invention to be filled with water. The pool 10 is typically unfolded with the bottom wall 12 spread out on a generally level surface, and the top ring 36 is inflated. The panels 30 in the sidewall 16 of the pool 10 make the sidewall 16 sufficiently rigid when the top ring 36 is inflated so that the sidewall 16 will remain upright, resisting the dynamic conditions resulting from partial pool filling, so that the pool 10 can be filled with water. Water in the pool 10 exerts an outward force against the sidewall 16, so that the reinforced sidewall 16 becomes quite strong and stable in retaining the water, and resisting outward bending and bowing, even when there is rough pool play. When it is desired to drain the pool 10 and fold up the pool for storage, the top ring 36 can be deflated through the inflation stem (not shown), and the sidewall 16 pressed down at one side to allow water to flow out of the pool 10. The sidewall 16 can be collapsed and the pool can be folded according to the dimensions of the panels 30 for storage.

It can thus be readily appreciated that the collapsible pool 10 of the invention provides for a collapsible panel wall pool with a reinforced, panelled sidewall 16 that can better withstand rough play, that can stand without outside support due to the presence of an inflatable top ring 36, and that provides for cushioning on contact with the top of the sidewall 16. Although bonding of the portions of the pool 10 together has been described as being by heat seals of the thermoplastic material, it should be obvious that other types of bonding, such as adhesive bonding, may also be used, and that other types of plastic materials, such as flexible thermosetting plastics, are also well known in the art, and may also be suitable for use with the invention.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A panel wall pool, comprising:

a bottom wall having an outer edge;

a peripheral upright wall connected to the outer edge of the bottom wall, said peripheral upright wall being formed of at least two layers of heat sealable material and containing a plurality of spaced apart, vertically oriented pockets sealed at the bottom and top edges of said upright wall;

a plurality of rigid, generally rectangular planar panels disposed within said peripheral upright wall, with each of said panels being sealed in one of said pockets;

a plurality of heat seal regions each positioned between two of said plurality of spaced apart pockets, with each heat seal region including a plurality of vertical heat seals and a plurality of horizontal heat seals extending between each of said vertical heat seals for providing support to said upright wall, each of said vertical heat seals being common with a corresponding vertical seal of an adjacent pocket;

a reinforcing band positioned between said two layers of material for encircling said planar panels; and an inflatable top ring connected to the top edge of the upright wall.

2. The pool of claim 1, wherein said pockets formed by said two layers of heat sealable material are comprised of plastic material.

3. The pool of claim 1, wherein said plurality of heat seal regions includes at least three horizontal heat seals extending between said vertical heat seals of said layers of heat sealable material.

4. The pool of claim 1, wherein said reinforcing band is formed of nylon.

5. The pool of claim 1, wherein said reinforcing band is formed of polyvinyl chloride.

6. The pool of claim 1, wherein said bottom wall, peripheral upright wall, and inflatable top ring are formed from a thermoplastic sheet material selected from the group consisting of polyvinyl chloride, polyvinyl chloride copolymers, polymers containing the vinyl radical, polymers containing the vinylidene radical, nylon, linear polyethylene, polystyrene, and polypropylene.

7. A collapsible panel wall wading pool, comprising:

a bottom thermoplastic wall having an outer edge;

a peripheral upright wall connected to the outer edge of the bottom thermoplastic wall, said peripheral upright wall being formed of at least two layers of heat sealable thermoplastic material and containing a plurality of spaced apart, vertically oriented pockets heat sealed at the bottom and top edges of said upright wall;

a plurality of wooden rectangular planar panels disposed within said peripheral upright wall, with each of said wooden panels being heat sealed in one of said pockets;

a plurality of heat seal regions each positioned between two of said plurality of spaced apart pockets, with each heat seal region including a plurality of vertical heat seals and a plurality of horizontal heat seals extending between each of said vertical heat seals for providing support to said upright wall, each of said vertical heat seals being common with a corresponding vertical heat seal of an adjacent pocket;

a thermoplastic reinforcing band positioned between said two layers of thermoplastic material for encircling said planar panels, said reinforcing band being heat sealed to said vertical heat seals; and an inflatable thermoplastic top ring heat sealed to the top edge of the upright wall for facilitating the set-up of said collapsible pool and for providing cushioned support.

* * * * *